United States Patent [19]

Pfeiffer et al.

[11] Patent Number: 4,667,959

[45] Date of Patent: May 26, 1987

[54] APPARATUS FOR STORING AND SELECTING CARDS

[75] Inventors: Arthur M. Pfeiffer; Christopher A. Tacklind, both of Palo Alto; Michael D. Haas, El Sobrante; James M. Zeiszler, Palo Alto, all of Calif.

[73] Assignee: Churkendoose, Incorporated, Palo Alto, Calif.

[21] Appl. No.: 759,654

[22] Filed: Jul. 25, 1985

[51] Int. Cl.[4] ..... A63F 1/14

[52] U.S. Cl. ..... 273/149 R; 221/265

[58] Field of Search ..... 273/149 R, 148 A, 138 A, 273/85 CP, 149 P; 221/224, 225, 233, 265

[56] References Cited

U.S. PATENT DOCUMENTS

| | | | |
|---|---|---|---|
| 2,706,117 | 8/1950 | Notz | 273/149 R |
| 2,755,090 | 7/1956 | Aldrich | 273/149 R |
| 3,627,331 | 12/1971 | Erickson | 273/149 R |
| 3,889,956 | 6/1975 | Castle | 273/138 A |
| 4,033,590 | 7/1977 | Pic | 273/149 R |
| 4,052,057 | 10/1977 | Castle | 273/1 E |
| 4,093,215 | 6/1978 | Ballard | 273/1 E |
| 4,099,810 | 7/1978 | Stange | 312/183 |
| 4,145,038 | 3/1979 | Mol | 270/58 |
| 4,250,028 | 2/1981 | Talyzin et al. | 209/583 |
| 4,358,016 | 11/1982 | Richardson et al. | 209/564 |
| 4,373,185 | 2/1983 | Mills et al. | 364/478 |
| 4,396,193 | 5/1981 | Reinhardt et al. | 273/138 A |
| 4,497,488 | 2/1985 | Plevyak et al. | 273/149 R |
| 4,512,580 | 4/1985 | Matviak | 273/149 R |
| 4,515,366 | 5/1985 | Hamano | 273/138 A |
| 4,534,562 | 8/1985 | Cuff et al. | 273/149 R |

*Primary Examiner*—Richard C. Pinkham
*Assistant Examiner*—MaryAnn Stoll Lastova

[57] ABSTRACT

A card apparatus having a card hopper adapted to hold from one to at least 104 cards, a card carousel having slots for holding cards, an injector for sequentially loading cards from the hopper into the carousel, output ports, ejectors for delivering cards from the carousel to any one of the output ports, and a control board and sensors, all housed in a housing. The apparatus is also capable of communicating with selectors which are adjustable for making card selections. The injector has three rollers driven by a motor via a worm gear. A spring loaded lever keeps cards in the hopper pressed against the first roller. The ejectors are pivotally mounted to the base of the housing beneath the carousel and comprise a roller driven by a motor via gears and a centripetal clutch. A control board keeps track of the identity of cards in each slot, card selections, and the carousel position. Cards may be ordinary playing cards or other cards with bar codes added for card identification by the apparatus.

27 Claims, 11 Drawing Figures

APPARATUS FOR STORING AND SELECTING CARDS

Description

1. Technical Field

The present invention relates to a computer controlled game apparatus which is able to store, keep track of, and deliver random or selected cards.

2. Background Art

U.S. Pat. No. 4,093,215 to Ballard describes a computer controlled game system adapted for bridge. The system includes a central display unit and several separate hand-held player units, each coupled to the central unit. The hand-held units display an individual player's hand and are used to select a card for play. The central unit electronically deals the cards, keeps track of bidding and scoring, and displays the cards played. U.S. Pat. Nos. 3,889,956 and 4,052,057 to Castle disclose similar electronic card games. All of the games involve simulations of the actual playing cards, rather than use the cards themselves.

U.S. Pat. No. 4,497,488 to Plevyak et al. discloses a computerized card shuffling machine for casinos which uses the actual playing cards. The machine has an input shoe for holding a stack of cards to be shuffled, a revolving wheel with many card receiving stations, an output shoe for receiving the shuffled cards, a mechanism for shifting the card receiving stations to match random stations with the input and output shoes, and a card transfer mechanism for feeding cards from the input shoe to a matched station or from a matched station to the output shoe. There are only twelve to eighteen card receiving stations. The patent states that more than eighteen stations result in prohibitive manufacture and maintenance costs, while less than twelve result in too long a shuffling time. The shuffler thus never holds an entire deck of cards.

U.S. Pat. No. 4,033,590 to Pic discloses a card dealing machine in which a rotatable table supports a preshuffled deck of cards. During rotation of the table, a reciprocating card ejection mechanism ejects cards at player locations about the device. The device stops rotating after the last card to be dealt has been distributed.

In U.S. Pat. No. 4,250,028 to Talyzin et al. a machine for automatic sorting and retrieval of flat objects, such as data cards, is disclosed. The machine has a cylindrical housing on whose walls storages of flat objects are arranged in several decks over the periphery thereof. A feeder for feeding individual flat objects from an array of objects into the machine includes a separator for separating the objects one-by-one from the array, a mechanism for conveying objects to the storages, and an optoelectronic reader for identifying distinguishing features on the objects. A conveyor delivers groups of objects from the storage. A squirrel-cage return drum accommodated inside the housing carries on its spokes object holders, containers and cams for moving the objects about in the housing.

An object of the present invention is to provide an apparatus into which a deck or stack of cards may be loaded and which then randomly distributes cards to a number of output ports.

Another object of the invention is to provide an apparatus into which a deck of bar coded or identification-marked cards may be read and loaded and which then delivers user selected cards to each of a number of output ports.

Another object of the invention is to provide a card game apparatus that can deal a standard set of card games and that can be easily instructed by the users to deal and play other card games.

Another object of the invention is to provide a card game apparatus that is small, light and battery powered so as to be easily transportable.

Another object of the invention is to provide a card game apparatus that is inexpensive, reliable, and operates quickly.

DISCLOSURE OF THE INVENTION

The above objects have been met with a card handling apparatus in which cards are loaded into, stored in and dealt from a compact carousel around which users or players may be seated. The carousel has a base plate rotatably mounted on a central hub and dividers protruding radially up from the base plate to form slots. Each slot may hold one card and generally there are more than 104 slots on a carousel. A motor and belt engaging the carousel base plate rotates the carousel so that a particular slot is in position to have a card transferred into or out of it, i.e. to receive a card from an input hopper or to deliver a card to an output port. The carousel is not restricted to storing playing cards but may also handle flat articles which resemble playing cards, such as index cards or study cards. Cards are placed in a card hopper capable of holding at least 104 cards. The hopper may be top loaded or side loaded. A spring-loaded lever holds the cards firmly against a roller, which is part of an injector mechanism.

The injector loads cards one at a time into the empty slots of the carousel. The injector typically includes three rollers driven by a motor. The first and third rollers turn in directions to drive each card from the hopper to the carousel. The second roller turns contrary to card flow to insure that only one card is injected at a time by driving any other cards back into the hopper. This process is facilitated by allowing injection clearance for only one card. The third roller may turn faster than the first and second rollers to space the cards to allow time for the carousel to rotate to the next empty slot. For identification-marked cards, a sensor reads identification markings, such as bar codes, as each card is loaded into the carousel, so that the apparatus can keep track of which slot holds which card.

Distributed around the carousel are a plurality of player positions or user stations, each comprised of an ejector, an output port, a selector, and a selector recess. At each user station there is an ejector mechanism to deliver cards. When the ejector is activated, a small roller is lifted up into a slot pinching the contained card against a wall of the slot. The arc of the lifting roller is such that the desired card will be engaged regardless of its position, yet adjacent cards will not. The roller turns driving the card briskly into the output port. The lifting of the roller and driving of the card is typically accomplished with a small motor. A centripetal clutch exerts a torque on the roller assembly bringing the roller into place. A pinion protruding through the clutch meshes with a crown gear fixed to the shaft of the roller to rotate the roller. When the motor turns off, the clutch disengages, and gravity pulls the roller back down. A viscous drag or friction clutch may also be used.

Each user station has an output port which catches cards ejected from the carousel. The floor of the output port is generally lower than the carousel floor so that many cards may be ejected without interference from previously ejected cards. A projection in each output port causes cards that have been loaded properly into the carousel to fall face down onto the floor of the output port. The corner of the output port beneath the lower edge of the card may be rounded to enable the card to fall without catching on its edge. At each output port is a liftable door beneath which is a slit and finger-hole through which cards may be removed. The slot is generally thin and the finger hole is situated so as to minimize the possiblity of seeing the value of the card as it falls.

A control board contains most of the electronics for the apparatus. A microprocessor is mounted on the control board which is typically situated under the carousel and is used to control and direct numerous operations. It communicates with the sensors of the injector and of the carousel. It controls the movement of the carousel, the injector and ejectors. It keeps track of which slots contain cards and keeps track of which identification-marked cards are in which slots. It generates a random distribution of cards and delivers any number of them in any order to any number of ports. While preferably the computer is pre-programmed to play a variety of games it may also be re-programmed by the use of special cards or by an interface to an external programming device.

The game apparatus has selector recesses at each user station which are adapted to receive selector units. Each selector is preferably a hand held unit which can be set to one of a number of settings. Dials or slides or buttons on the selector may be used to make the selection. These selectors are used in those games or applications where the players or users request cards. These selector units may also be used to indicate an active user station, i.e. one at which a user is present.

In particular, the selectors may be used with a card game called "Pickem". In "Pickem", a deck of 52 playing cards plus 49 or more "null cards" are used. Both playing and null cards must be identification-marked so that the game apparatus can identify each card. Two to eight players may play. Winning and betting are similar to poker. Unlike poker, however, players receive cards by their own selection. At each round, each player selects a card and the apparatus delivers either the card selected or a null card, depending on the circumstances. Null cards are special cards that have no value. There may be a time limit for selecting a card. Players not completing a selection before time runs out receive a null card. If more than one player selects the same card, each of them receives a null card. If a player selects a card dealt to someone on a previous round, then a null card is received.

The game apparatus of the present invention is a portable unit that quickly and reliably randomly deals standard playing cards. It keeps track of which slots contain cards. It also keeps track of cards that are identification-marked so that users can play games, such as "Pickem", in which players request particular cards. It can also be used for other card handling purposes such as sorting, shuffling, and dealing standard sized cards that are or are not identification-marked playing cards or cards containing a variety of data.

BEST MODE FOR CARRYING OUT THE INVENTION

Figure 1:
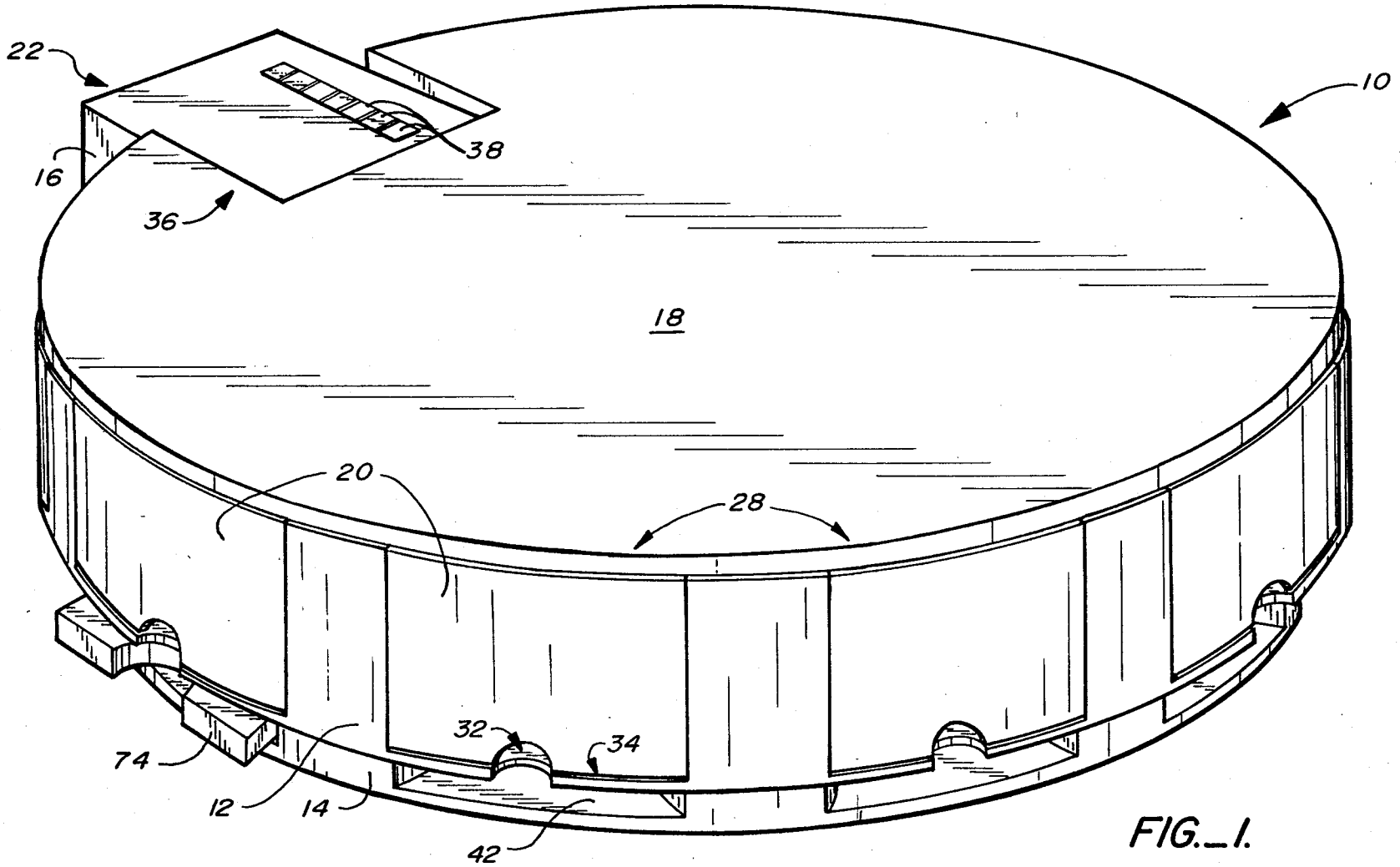
FIG. 1 is a perspective view of the apparatus of the present invention.

With reference to FIG. 1, a card game apparatus 10 has a frame 12 seated on a molded base 14. Typical dimensions for apparatus 10 are a diameter of about 18 inches (46 cm) and a height of about 4 inches (10 cm). A carousel cover 18 seated on top of the apparatus 10, and a plurality of hinged output doors 20 close the top and side wall sections of frame 12. They are liftable for access to the working parts in the interior of apparatus 10. Preferably, the frame is made of molded plastic, combining durability and light weight, but other materials may also be used.

A plurality of user stations 28 are distributed around the apparatus. Each user station 28 has an output port where cards are delivered face down. Dealt cards are removed from an output port through a slit 34 under hinged output door 20. A finger notch 32 formed in base 14 and door 20 at each user station 28 permits player access to dealt cards in the output port without having to lift door 20.

The apparatus has selector recesses 42 adapted for receiving selectors 74 indicating a user's card selection. Recesses 42 are typically positioned at each player position 28 in molded base 14 beneath the corresponding output port. Selector dials, slides or buttons on the selector may be provided to make the card selection. Once inserted the selector makes contact through a connector to register the desired selection. Alternatively, selectors may communicate card selections to the apparatus 10 via wired connection or infrared beams.

Typically, the selector displays the selection through a small window, thus keeping the information private. A window on the selector displaying public information for others to see may also be included. Once the selector is inserted into a recess the private windows are covered while the public windows may be exposed.

Figure 2:
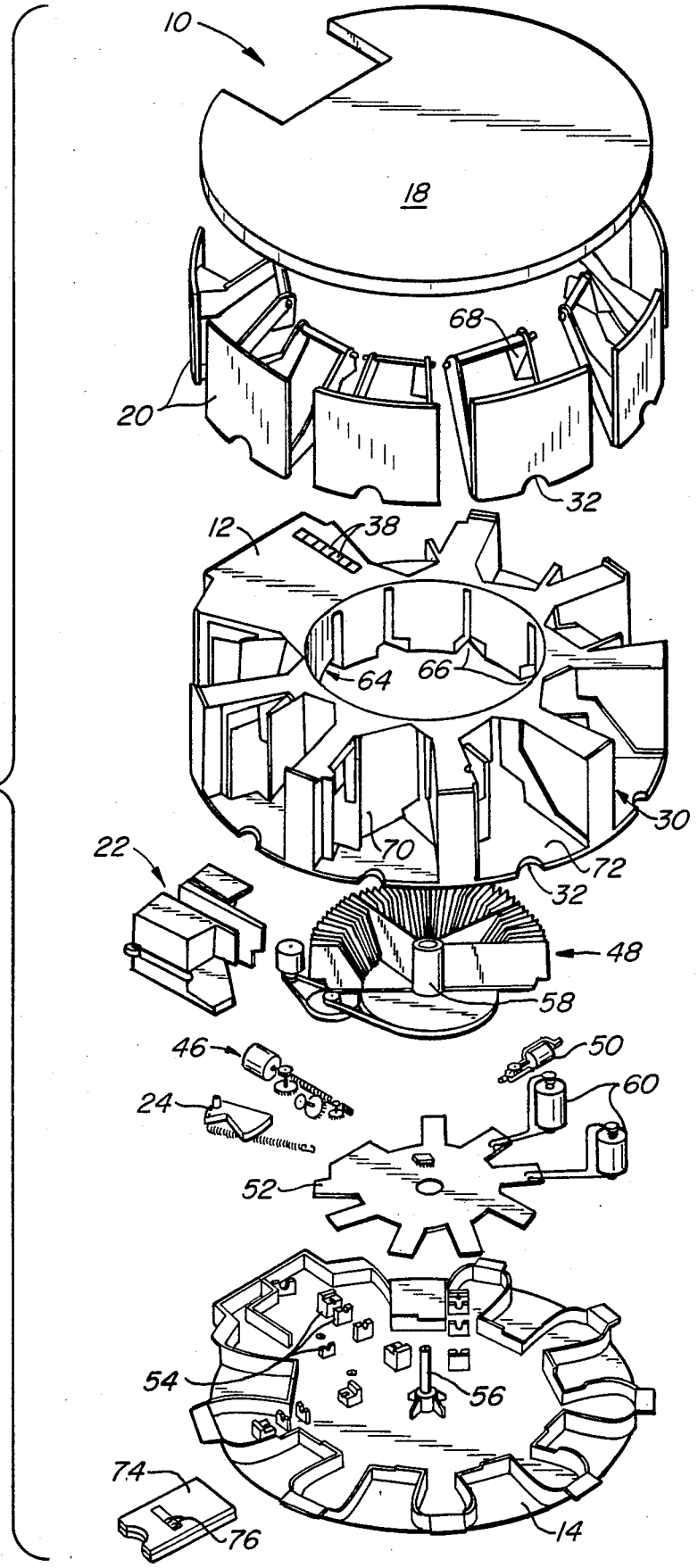
FIG. 2 is an exploded perspective view of the apparatus of FIG. 1.

With reference to FIG. 2, the interior of apparatus 10 can be seen to comprise an injector 46, a hopper 22, a carousel 48, an ejector 50 for each output port 30, and a control board 52. The output ports 30 are part of frame 12. Injector 46 and ejectors 50 are mounted on supports 54 molded into base 14. Hub pin 56, projecting from the center of molded base 14, turnably supports carousel 48 at a hub 58.

A card input hopper 22 mounted in frame 12 can hold at least 104 cards which are within a specified size range. Typically, this range includes standard poker and bridge playing cards. A spring-loaded lever 24 holds the cards flat against a side wall 26 of the hopper 22. One or more decks of playing cards are loaded into hopper 22. The hopper 22 may be top loaded or side loaded. For top loading, the lever is manually retracted. For side loading, the insertion of the cards may retract the lever. The cards are then fed one at a time into apparatus 10.

Cards loaded into card hopper 22 are fed by injector 46 through an opening 64 in back of hopper 22 into carousel 48. Cards are delivered to appropriate output ports 30 by their corresponding ejectors 50. Cards ejected from carousel 48 pass through openings 66 in back of the output ports 30 into the output ports 30. Projection 68 at each output port 30 contacts the top edge of an incoming card, causing it to rotate and thus fall flat onto the floor 72 of output port 30. The port's rear wall 70 is angled to bring the card to the front of the port 30 while it falls. Cards are then removed from output port 30 through slit 34 or by lifting door 20.

Injector 46, carousel 48 and ejectors 50 are motor driven and powered by batteries 60. Each battery is situated in an output port 30 behind door 20. Batteries 60 also provide electric power to control board 52. Typically, four or more D size 1.5 volt batteries provide sufficient power to operate apparatus 10. An external connector is provided for alternate power sources.

Selectors, such as selector 74, are used to indicate an active user station and to select cards in those card games where the players request specific cards. Each selector 74, which is about the size of stack of 30 cards can be set with dials 76 to one of a number of settings for the desired communication and inserted into recess 42 which incorporates a connector. A standard computer interface may also be included via extra pins in one of the selector recesses 42. Alternatively, selector 74 may be set with buttons or slides. Several user control buttons such as pass, deal, etc. may be included on selector 74 or at each user station 28. Also, communication between selectors 74 and control board 52 may be by wires or infrared beams.

Figure 3:
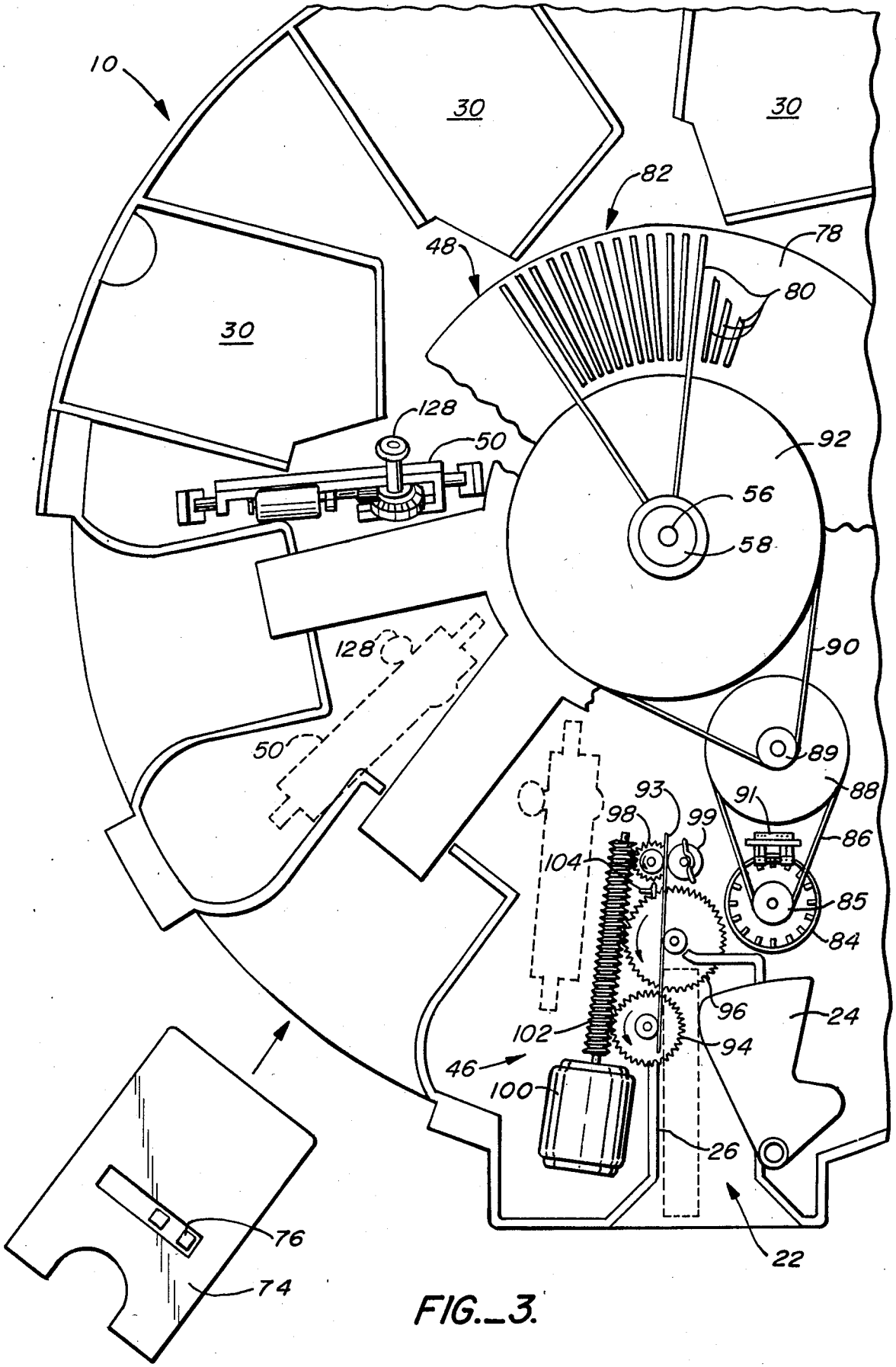
FIG. 3 is a top cutaway view of the apparatus of FIG. 1.
Figure 4:
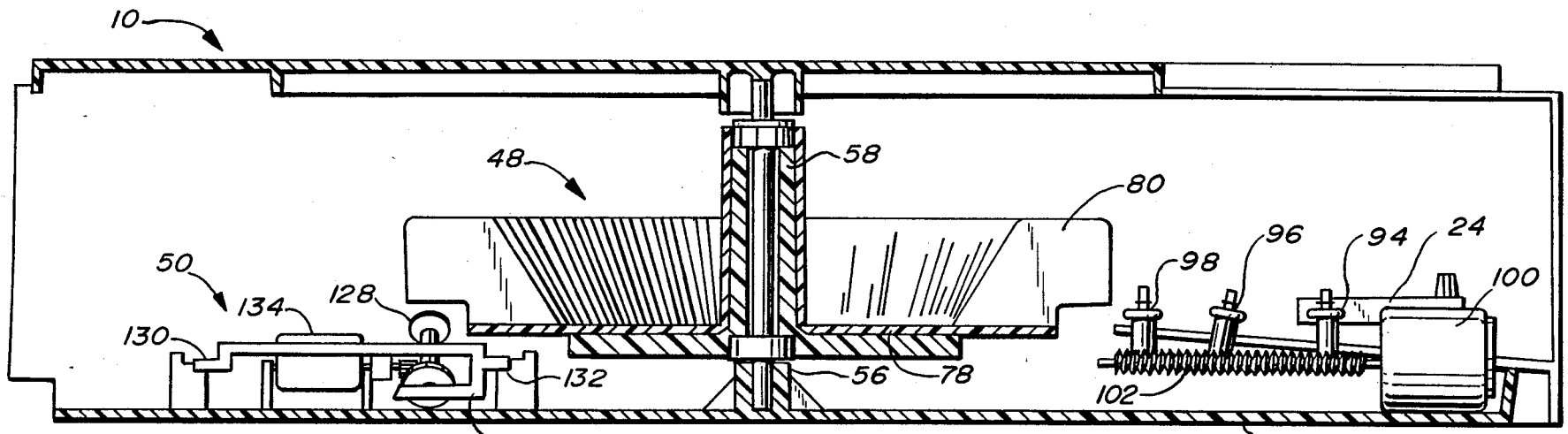
FIG. 4 is a side cutaway view of the apparatus of FIG. 1.
Figure 5:
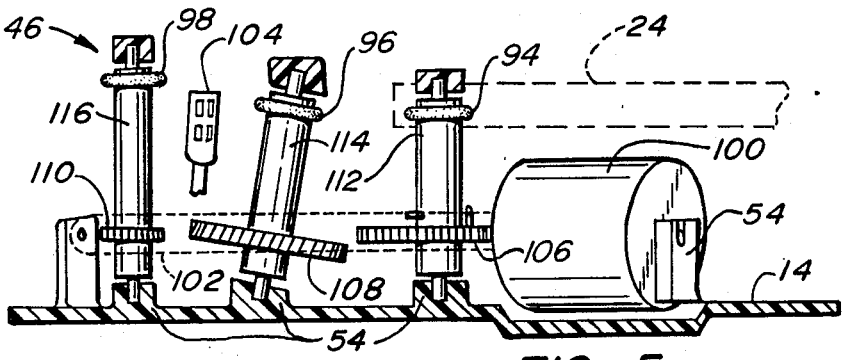
FIG. 5 is a side view of the injector mechanism used in the apparatus of FIG. 1.

With reference to FIGS. 3 and 4, injector 46 loads cards 93 one at a time from card hopper 22 into slots 82 of carousel 48. Injector 46 preferably has three driven rollers 94, 96 and 98 which are driven by an injector motor 100 via a worm gear 102. Injector 46, seen in greater detail in FIG. 5, sits on molded base 14 supported by supports 54. Each roller 94, 96 and 98 is a small, preferably rubberized, wheel on shafts 112, 114 and 116 having gears 106, 108 and 110 respectively. Gears 106, 108 and 110 each engage worm gear 102 driven by motor 100. Typically, third gear 110 is about one-third as small as first and second gears 106 and 108.

Spring loaded lever 24 holds a deck of cards firmly against first roller 94. In FIG. 3, first roller 94 turns in a direction such that card 93 is driven toward carousel 48. The second roller 96 turns in the same direction as first roller 94, but cards contact the opposite side of second roller 96 from first roller 94, so all but the first card are pushed back into the hopper. Second roller 96 is preferably spaced so that it firmly contacts the second card to drive it back, but does not contact the first card 93 which continues toward carousel 48. Third roller 98 drives card 93 into an empty slot 82 of carousel 48.

The second and third rollers may be spring loaded against the card or a spring loaded idler wheel such as 99 may be used to insure contact. Alternatively, a recess may be provided into which the card must be deflected by the roller in order to pass. Since cards have some rigidity they act effectively as a spring, insuring contacte with the rollers.

The hopper 22 is tilted upward toward the carousel at between zero and fifteen degrees. This prevents interference with cards in adjacent slots 82 in carousel 48. However, the first and third rollers 94 and 98 are mounted with their axes perpendicular to the base 14 and so are angled between zero and fifteen degrees relative to the hopper 22. The second roller 96 is angled between zero and fifteen degrees relative to the hopper 22 but in the opposite direction. Thus its axis is between zero and thirty degrees relative to the base of 14. As the three rollers turn, the cards are thus driven down to the floor of hopper 22. This keeps the card loaded against the bottom of hopper 22 and thus in alignment with scanner 104.

Figure 6:
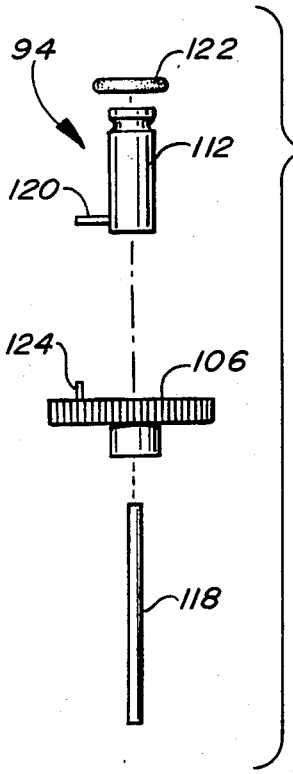
FIG. 6 is an exploded detail of the first roller of the injector of FIG. 5 incorporating a finger clutch.

To allow time for carousel 48 to rotate the next empty slot into position before the next card is inserted, third roller 98 turns faster than first and second rollers 94 and 96. To prevent binding while both the first and third rollers 94 and 98 are engaged on card 93, first roller 94 is equipped with a finger clutch, seen in FIG. 6. First roller 94 has a wheel 122 on a shaft 112 with a gear 106. Gear 106 and shaft 112 are not fixed together. A pin 118 goes through the center of gear 106 and shaft 112 and allows roller 94 to turn on its support 54.

When a card 93 engages only first roller 94, gear 106 turns causing finger 124 to engage finger 120. Gear 106 and shaft 112 with wheel 122 then turn in unison, driving card 93 toward carousel 48. When card 93 engages both first and third rollers 94 and 98, card 93 is driven by third roller 98 at increased speed into carousel 48. Shaft 112 is forced to turn faster than gear 106 causing the fingers to disengage. Shaft 112 then turns independently from gear 106 for nearly one rotation, accommodating the period of dual engagement. When the card disengages roller 94, shaft 112 stops until gear 106 rotates to engage fingers 120 and 124 again. This introduces an additional delay further separating the cards.

A sensor or scanner 104 is disposed for reading identification-markings on a card 93 being loaded from hopper 22 into carousel 48. Scanner 104 is a first transducer means which is preferably an optical scanner that reads bar codes printed or attached in strips onto the cards. The injector rollers are generally slightly tilted relative to the card path so that the roller drives the card so that it is lined up with the scanner. The bar code is preferably on the face side of the card. It is parallel to and along both of the longer edges so that reading is possible in two orientations. Distinguishing details of ordinary playing cards may also be read if enough optical scanners are used. Alternatively, scanner 104 may be a magnetic or other type of scanner that can sense identification data on the cards. Scanner 104 may also read an instruction card with a bar code or other type of data containing program parameters for a specific game. Scanner 104 is in communication with control board 52, containing a microprocessor which is able to keep track of which slots contain cards and which cards are in which slots.

With reference again to FIGS. 3 and 4, carousel 48 consists of a flat base plate 78 with many dividers 80 protruding up from carousel base 78 to create slots 82 for individual cards. Typically, the dividers 80 are about half as high as standard playing cards are wide, i.e. about 1 ¼ inches (3 cm) high, and protrude into the center of carousel 48 toward hub 58 about one third of the way. This allows each card maximum freedom in its slot 82 in order to prevent jamming. Several of the dividers 80 extend all of the way to hub 58 to keep cards from sliding around the hub. Hub 58 is free to rotate on hub pin 56, which is mounted to or part of molded base 14.

Carousel 48 is driven by a small motor 84 with a cogged pulley 85 powered by batteries. A cogged belt 86 wraps around pulley 85 and a pulley 88. Typically, the diameter of pulley 88 is about four to ten times larger than the diameter of pulley 85. A second pulley 89 is fixed coaxially to and rotates with pulley 88. A cogged drive belt 90 wraps around second pulley 89 and a carousel pulley 92 coaxially fixed to carousel base 78. Typically, the diameter of carousel pulley 92 is about four to ten times larger than the diameter of second pulley 89. Thus, 16 to 1000 rotations of pulley 85 turns carousel 48 once around. Motor 84 is capable of turning at over 5000 rpm and is thus capable of turning the carousel at an angular velocity of 5 to 312 rpm, depending on the relationship of the pulleys.

Motor 84 positions carousel 48 accurately to within a fraction of a degree. This is typically accomplished with a closed loop servo controller, which generally employs an optical encoder wheel attached to pulley 85. Optical emitters and detectors 91 are positioned in relation to the encoder wheel such that light from the emitters is interrupted by the rotating wheel and detected to provide position feedback. The motor 84 is preferably driven in a proportional manner using pulse-width modulation. Polarity and pulse-width modulated voltage to the motor are commanded by control board 52 and derived from current position, desired position, previous position and external factors, such as varying moment of inertia due to the presence or absence of cards. Preferably, the well known method of a digital proportional-integral-derivative control law is used. Alternatively, other methods of feedback and motor control may be used to turn and position the carousel so that cards are injected or ejected in a fast and efficient manner.

In FIGS. 3 and 4, ejectors 50 are positioned around carousel 48, one beside each output port 30. Each ejector 50 sits on a rocker 136 which is supported on pivots 130 and 132 above molded base 14. When motor 134 is turned on, the ejector 50 pivots, lifting roller 128 into position between dividers 80 for driving a card from slot 82 into output port 30. The angle of roller 128 against the card is generally selected to make the roller 128 self-energizing, drawing it into firm contact with a card. Typically, the axis of roller 128 is about 45 degrees from vertical and the ejector 50 is aligned 20 degrees off from the radial direction. However, these angles may vary.

Figure 7:
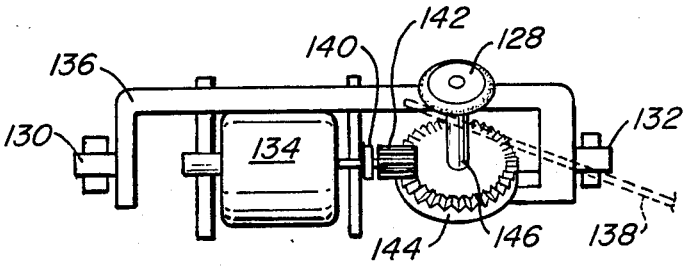
FIG. 7 is a top view of the ejector mechanism used in the apparatus of FIG. 1.
Figure 8:
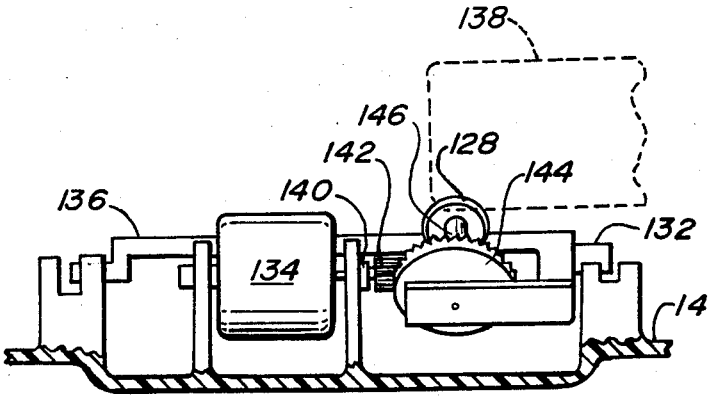
FIG. 8 is a side view of the ejector.

Ejector 50, seen in FIGS. 7 and 8 in greater detail, has an ejector motor 134 seated on a rocker 136. Rocker 136 is pivotally supported on pivots 130 and 132 above molded base 14. A centripetal clutch 140 is connected to motor 134. A pinion 142 protruding through centripetal clutch 140 meshes with a crown gear 144. Crown gear 144 is rotatably mounted on its axis to rocker 136. Roller 128 is fixed to the tip of an extension of crown gear 144. Shaft 146 is fixed on the end opposite roller 128 to the rocker 136.

In operation, when motor 134 is turned on, centripetal clutch 140 exerts a torque on the ejector causing rocker 136 to pivot on pivots 130 and 132. This brings roller 128 into place against card 138. Pinion 142 turns crown gear 144 which causes roller 128 to turn, driving the card out of the carousel. When motor 134 is turned off, centripetal clutch 140 disengages and gravity pulls roller 128 down and away from the slot.

An alternative method for ejecting cards involves the seperate actions of first lifting the card and then driving the card. From below, a lifter mechanism lifts the end of one card up and slightly out of the carousel. A pair of angled rollers turning above the slot then grab the edge of the card and eject the card radially from the carousel. The lifters for all user stations may be actuated by a common motor. In this case individual motors turn only those rollers at user stations where an ejection should occur. Or all the rollers could be driven with a common motor. In this case a separate motor or solenoid is used at each user station to lift only those cards to be ejected. The lifting may also be performed by activating a spiral ramp engaging the lifter. The spiral ramp turns on the shaft of the motor which drives the roller for that user station. After ejection the motor is reversed bringing the lifter back down. Alternatively, a single ejector mechanism of any of the types above may be mounted coaxially with the carousel. This assembly is then rotated to the user station where an ejection is needed.

The card game apparatus 10 is controlled by the control board 52, containing a microprocessor. The microprocessor communicates with sensor 91, scanner 104, the selectors 74 and the control panel 38 to keep track of carousel position, the identity of cards in each slot, card selections, and the like, and commands the various motors to inject cards, turn the carousel, and eject cards.

Control board 52 is also in communication with sensors for commanding the carousel to perform as a sensing means. The carousel may be driven by a stepping mechanism, a stepper motor or a servo motor. The latter choice allows the carousel, under control of the microprocessor, to be used as a sensing means. If a card is made to interfere with the carousel, the carousel's failure to rotate is sensed and the microprocessor may then initiate corrective measures. A protrusion of the carousel can be made to interfere with a lifted ejector and thus the carousel's initialization position may be inferred by the microprocessor. Using the carousel as a sensing means can also enable the microprocessor to calibrate the location of each of the ejectors and the injector. This sensing means can also be used by the microprocessor to determine the amount of current needed to lift the ejectors.

Figures 9, 9A:
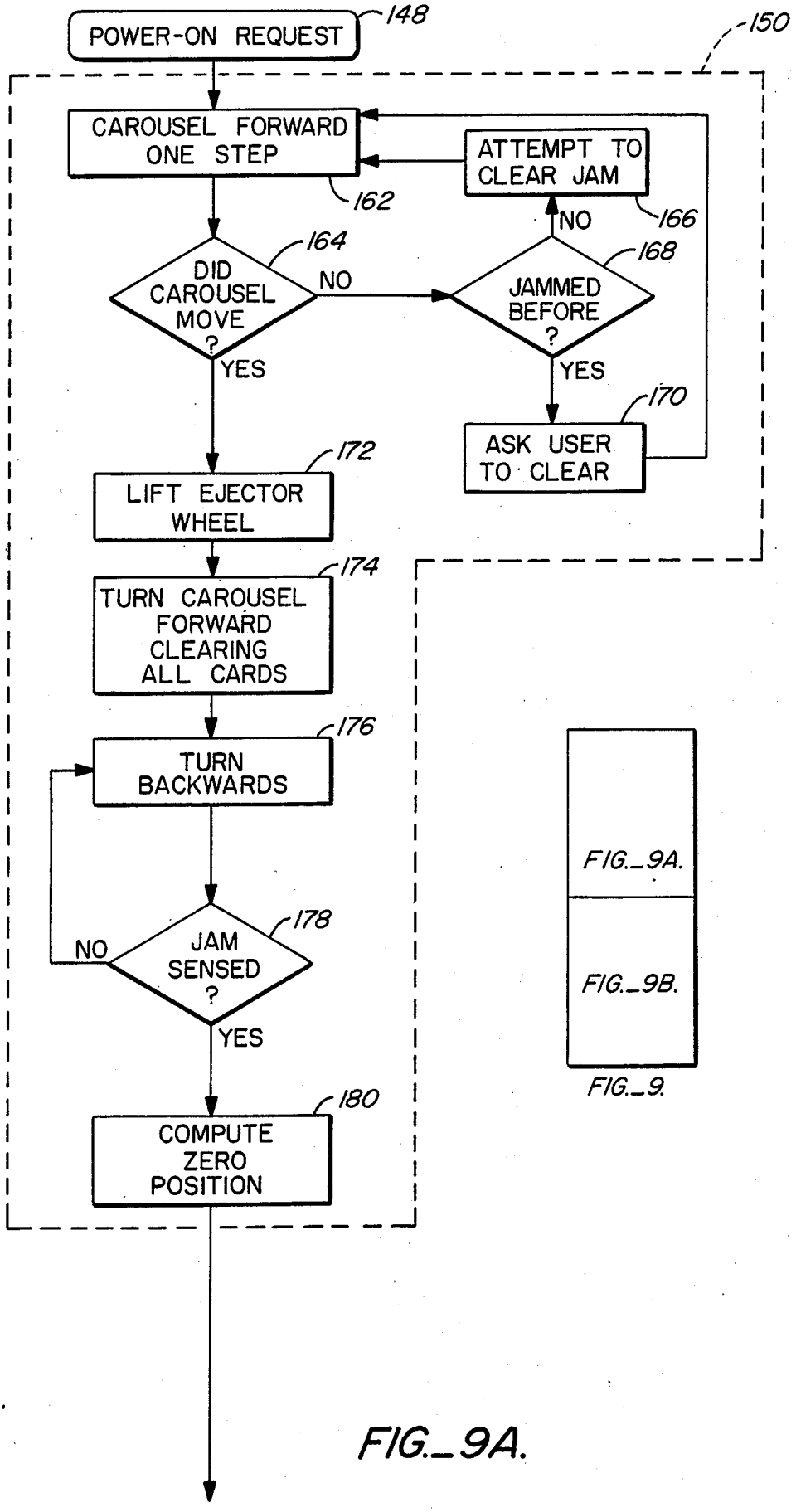
FIG. 9 is a plan showing the relationship between FIGS. 9*a* and 9*b*.
FIG. 9*a* is the top half of a flow chart of the operation of the apparatus of the present invention.
Figure 9B:
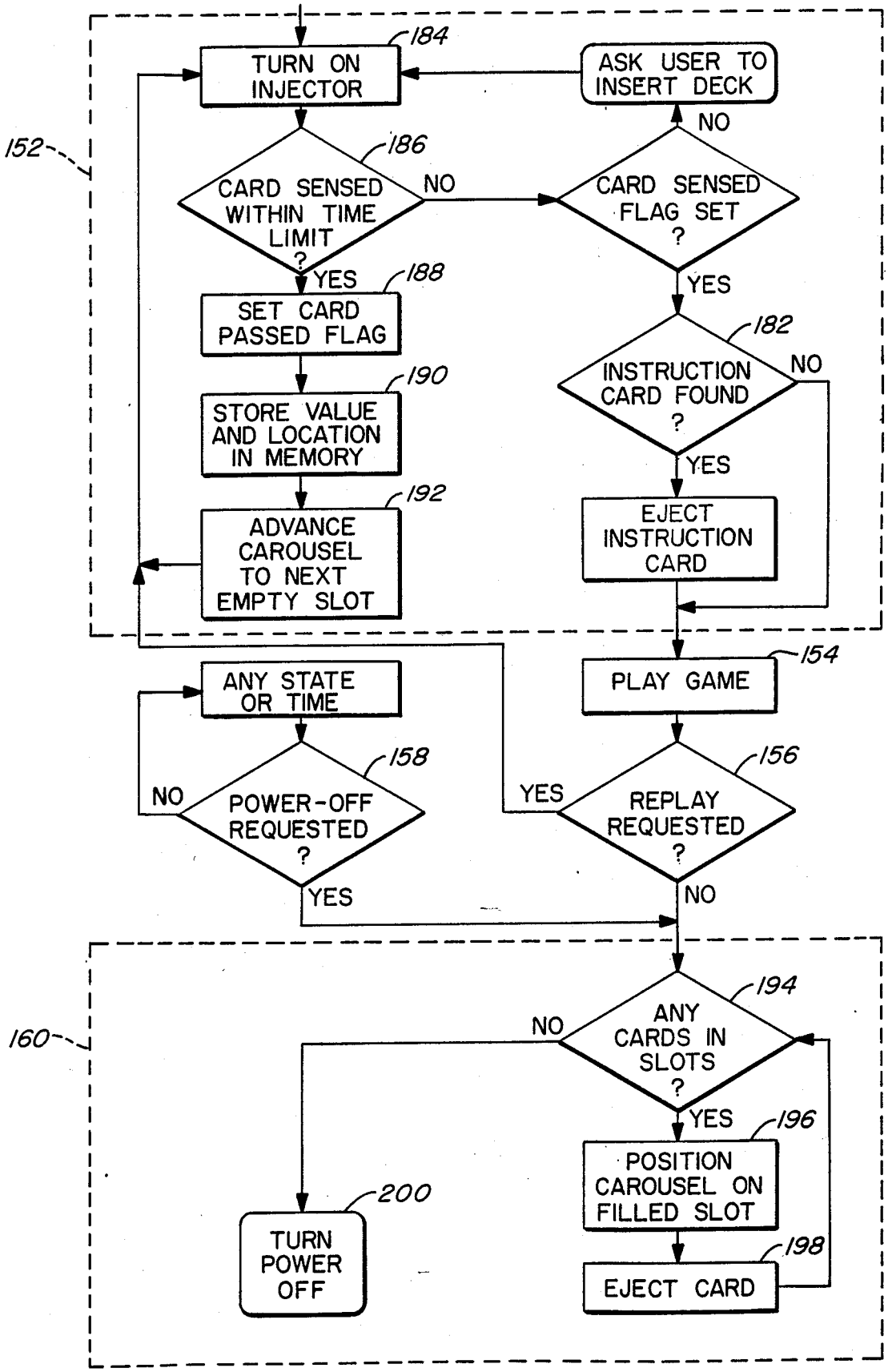
FIG. 9*b* is the bottom half of the flow chart of the operation of the apparatus of the present invention.

A control panel of buttons and indicators 38 is used to command and communicate a variety of functions such as 148, 170 and 152. With reference to FIG. 9, when the power is turned on, indicated by block 148, the game apparatus is initialized 150, then the user inserts cards 93 into the hopper 22 which are then loaded into carousel 48 by injector 46, as indicated by block 152. The game or activity is played, as indicated by block 154 and replayed, as indicated by block 156 one or more times. Cards are loaded 152 each time the game or activity is replayed. When play or activity is finished or any time power-off is requested, as indicated by block 158, the apparatus goes through a power-off sequence 160.

When the power is turned on 148, the mechanism is first initialized in three steps, as indicated by block 150. First, the carousel must be made free to turn. This will not be the case if a card is partially injected or ejected. The carousel is commanded to turn forward one step 162. If this command does not result in the expected motion 164, then a jam is inferred. In this case, each of the ejectors and the injector is turned on briefly in an attempt to clear the jam, as indicated by block 166. If the jam persists 168, the user is prompted to fix the problem manually 170. Second, when the carousel is free to turn, cards are cleared from the carousel. One or more ejectors are lifted into place, as indicated by block 172 and the carousel is systematically rotated slowly forward, as indicated by block 174. This results in the ejection of any cards that may be in the carousel. Third, an ejector 50 is raised and the carousel turns backward 176. One of the slots has a protrusion into which the center of the ejector roller runs causing a jam to be sensed 178. This establishes the zero position 180.

The user inserts cards into the hopper. After the apparatus is initialized 150, cards are loaded 152. The deck may also include an instruction card. This special card has the title and instructions for the game listed on it. Also specified in bar code or other identification markings, are program instructions for the control board. If no game selection card is entered, the apparatus is directed via control panel buttons as indicated by block 182. A user presses a control panel button, which turns on the injector motor bringing the first card past the sensor. If identification markings are detected, then the position of each card is stored in memory 190. Otherwise, the sensor is used only to signal the passage of card 186. In either case, the cards are counted and the slots used are registered 190. When one card is injected, the carousel quickly positions itself for the next card 192. This continues, as indicated by block 186, until all the cards are removed from the hopper.

The game or activity is played, as indicated by block 154, according to the instructions on the instruction card or via the control panel buttons. To play again 156, cards used are reentered into the hopper and reloaded 152 in preparation for the next game or activity.

Whenever power-off is requested, the apparatus goes into a power-off sequence 160. If any cards are still in the carousel 194, the carousel is rotated to the filled slot 196 and the card is ejected 198. This continues until the carousel is empty. Power is then turned off as indicated by block 200.

The apparatus is capable of playing many card games. In addition to being able to play standard card games, the instruction cards allow the apparatus to be used with any future game without having an elaborate user display and keyboard. This also allows the enthusiast to design his or her own games redefining the game operation and function of the control panel buttons by marking blank instruction cards.

We claim:

1. A card storage and distribution apparatus comprising, a storage carousel rotatably mounted on a central hub and having upright dividers extending radially from the hub on a carousel base forming card slots, a card hopper adjacent to the carousel adapted to hold a plurality of cards, an injector means associated with the hopper for loading said cards from the hopper into the slots in said carousel, a plurality of output ports disposed around the carousel, each port adapted to receive some of said cards from said carousel, an ejector means selectively communicating with the slots in said carousel for delivering a specific card in said carousel to a selected one of said output ports, carousel rotation means for rotating said carousel so that a selected slot of said carousel communicates with the ejector means, means for controlling card movement to and from said carousel and a plurality of card selectors, each selector corresponding to an output port, each selector being adjustable to one of a plurallity of settings representing at least the identity of a particular card, in communication with said control means, said control means including means to read identification markings on said cards there being a correspondence between said settings of said selectors and the identity of said cards delivered to said output ports.

2. The apparatus of claim 1 wherein each of said selectors has at least one window for viewing the settings of said selector.

3. The apparatus of claim 1 wherein said injector means comprises, an injector motor, a gear means connected to said injector motor for turning about an axis, a first roller turnable on a shaft engaging said gear means in a direction to drive a card in a forward direction, said first roller firmly contacting said card, a second roller engaging said gear means turnable in direction to drive other cards in a rearward direction, and a third roller engaging said gear means and turnable in a direction to drive said card in said forward direction, said first roller disengageable from said gear means to turn freely when one of said cards contacts both of said first and third rollers.

4. The apparatus of claim 3 wherein said second roller has spring means for firmly contacting said other cards, and said third roller has second spring means for firmly contacting said card.

5. The apparatus of claim 3 wherein said injector means further comprises means for deforming said card, said deforming being such as to provide firm contact between said card and said rollers.

6. The apparatus of claim 1 wherein each of said ejector means comprises, a roller turnable on a shaft, a crown gear fixed to said shaft and mounted to a rocker, a clutch with a pinion protruding therefrom and meshing with said crown gear, and an ejector motor connected to said clutch, said motor and said rocker pivotally mounted on knife edge pivots.

7. The apparatus of claim 6 wherein said clutch is a centripetal clutch.

8. The apparatus of claim 1 wherein each of said ejector means comprises lifting means for lifting a portion of one of said cards in a slot of said carousel out of said carousel, and driving means above said slot for engaging said portion and ejecting said card radially from said carousel.

9. The apparatus of claim 1 wherein said ejector means comprises a single ejector mechanism for ejecting cards from said slots mounted coaxially with said carousel and rotatable to deliver cards to any of said output ports.

10. The apparatus of claim 1 wherein said carousel rotation means comprises, a motor, and a belt engaging said motor and said base of the carousel.

11. The apparatus of claim 1 further defined wherein, most of said dividers extend one third of the way from the edge of said carousel base toward said central hub, the rest of said dividers periodically extending from the edge of said carousel base to the central hub.

12. The apparatus of claim 1 wherein each of said output ports has fin means for causing a received card to turn face down onto a floor of the port.

13. The apparatus of claim 1 wherein said card hopper has a spring loaded lever for holding said cards firmly against said injector means.

14. The apparatus of claim 1 wherein said means for controlling and selecting card movement comprises, a control board disposed for control of said carousel rotation means, said injector means and said ejector means, a sensor disposed for reading identification markings on a card being loaded from the hopper into the slots of said carousel, and an apparatus control panel with buttons for inputting game control information.

15. The apparatus of claim 1 wherein said means for controlling and selecting card movement is capable of causing said apparatus to randomly deal one or more cards to each of said output ports.

16. A card apparatus comprising, a card storage carousel having a plurality of radially extending dividers on a carousel base forming upright slots, each slot accommodating a card, a card hopper adjacent to the carousel adapted to hold a plurality of cards, an injector means associated with the hopper for loading said cards from the hopper into the slots in said carousel, at least one output port associated with the carousel for delivering cards from the carousel, an ejector means selectively communicating with the slots in said carousel for delivering a card in said carousel to said output port, carousel rotation means for rotating said carousel so that a selected slot of said carousel communicates with the ejector means, a plurality of cards disposed in the slots of said carousel, said cards having machine readable marks thereon for identifying each card, first transducer means associated with said injector for reading said machine readable marks on said cards, second transducer means associated with said carousel for tracking carousel position, wherein said second transducer means determines a carousel reference position by sensing a jam, there being a protrusion from said carousel at said reference position, and computer means communicating with said first and second transducer means whereby the position and identity of each card within said carousel is known.

17. The apparatus of claim 16 wherein said injector means comprises, an injector motor, a gear means connected to said injector motor for turning about an axis, a first roller turnable in a first direction on a shaft engaging said gear means, said first roller firmly contacting a playing card, a second roller turnable in said first direction engaging said gear means, and a third roller turnable in a second direction opposite to said first direction engaging said gear means, said cards having a length, said first and third rollers being spaced apart at a distance less than the length of said cards, said first roller disengagable from said gear means to turn freely when one of said cards contacts both of said first and third rollers.

18. The apparatus of claim 17 wherein said second roller and said third roller are spring biased.

19. The apparatus of claim 17 wherein said injector means further comprises means for deforming said card, said deforming being such as to provide firm contact between said card and said rollers.

20. The apparatus of claim 17 wherein said card hopper is tilted upward toward the carousel at between zero and fifteen degrees, the first and third rollers of said injector means having axes which are perpendicular to said carousel base, and the second roller of said injector means having axis which is tilted away from the carousel at between zero and thirty degrees.

21. The apparatus of claim 17 wherein each of said ejector means comprises, a roller turnable on a shaft, a crown gear fixed to said shaft and mounted to a rocker, said rocker pivotally mounted on knife edge pivots, a clutch with a pinion protruding therefrom and meshing with said crown gear, and an ejector motor connected to said clutch.

22. The apparatus of claim 21 wherein said clutch is a centripetal clutch.

23. The apparatus of claim 21 wherein the roller of said ejector in a card contacting position has an axis which is oriented at between 30 and 60 degrees from vertical and between 0 and 40 degrees from the radially extending dividers.

24. A card storage and distribution apparatus comprising, a deck of playing cards having machine readable marks thereon, a card storage carousel having a plurality of radially extending dividers forming upright slots, each slot accommodating a playing card, a card hopper adjacent to the carousel adapted to hold said deck of playing cards, an injector means associated with the hopper for loading said cards from the hopper into the slots in said carousel, at least one output port associated with the carousel for delivering cards from the carousel, an ejector means selectively communicating with the slots in said carousel for delivering a card in said carousel to said output port, carousel rotation means for rotating said carousel so that a selected slot of said carousel communicates with the ejector means, first transducer means associated with said injector for reading said machine readable marks on said cards, and second transducer means associated with said carousel for tracking carousel position, control means communicating with said first and second transducer means whereby the position and identity of each card within said carousel is known, and card selector means communicating with said control means for calling a selected card from said carousel to said ejector means.

25. A card storage and distribution apparatus comprising, a storage carousel rotatably mounted on a central hub and having upright dividers extending radially from the hub on a carousel base forming card slots, a card hopper adjacent to the carousel adapted to hold a plurality of cards, an injector means assocated with the hopper for loading said cards from the hopper into the slots in said carousel, said injector means having an injector motor, a gear means connected to said injector motor for turning about an axis, a first roller turnable on a shaft engaging said gear means in a direction to drive a card in a forward direction, said first roller firmly contacting said card, a second roller engaging said gear means turnable in a direction to drive other cards in a rearward direction, and a third roller engaging said gear means and turnable in a direction to drive said card in said forward direction, said first roller disengageable from said gear means to turn freely when one of said cards contacts both of said first and third rollers, a plurality of output ports disposed around the carousel, each port adapted to receive some of said cards from said carousel, an ejector means selectively communicating with the slots in said carousel for delivering a card in said carousel to a selected one of said output ports, carousel rotation means for rotating said carousel so that a selected slot of said carousel communicates with the ejector means, and means for controlling and selecting card movement to and from said carousel.

26. The apparatus of claim 25 wherein said second roller has spring means for firmly contacting said other cards, and said third roller has second spring means for firmly contacting said card.

27. The apparatus of claim 25 wherein said injector means further comprises means for deforming said card, said deforming being such as to provide firm contact between said card and said rollers.

* * * * *